United States Patent [19]

Christman

[11] 4,040,947

[45] Aug. 9, 1977

[54] MERCAPTAN EXTRACTION PROCESS UTILIZING A STRIPPED ALKALINE SOLUTION

[75] Inventor: William J. Christman, Barrington, Ill.

[73] Assignee: UOP Inc., Des Plaines, Ill.

[21] Appl. No.: 675,081

[22] Filed: Apr. 8, 1976

[51] Int. Cl.[2] ..... C10G 19/02; C10G 21/28

[52] U.S. Cl. ..... 208/235; 260/608

[58] Field of Search ..... 208/234, 235, 203, 204, 208/206; 260/680

[56] References Cited

U.S. PATENT DOCUMENTS

| | | | |
|---|---|---|---|
| 2,183,968 | 12/1939 | McCormick et al. | 208/235 |
| 2,921,020 | 1/1960 | Urban et al. | 208/234 |
| 3,044,856 | 7/1962 | Shirley et al. | 208/235 |

*Primary Examiner*—George Crasanakis

*Attorney, Agent, or Firm*—James R. Hoatson, Jr.; Robert W. Erickson; William H. Page, II

[57] ABSTRACT

Water is removed from an alkaline solution used to extract relatively high concentrations of mercaptans from a hydrocarbon stream by stripping the alkaline solution with a hydrocarbon vapor stream. The vapor stream is then admixed with the oxygen-containing off-gas stream of the process to enrich the off-gas stream above its explosive limit.

5 Claims, 1 Drawing Figure

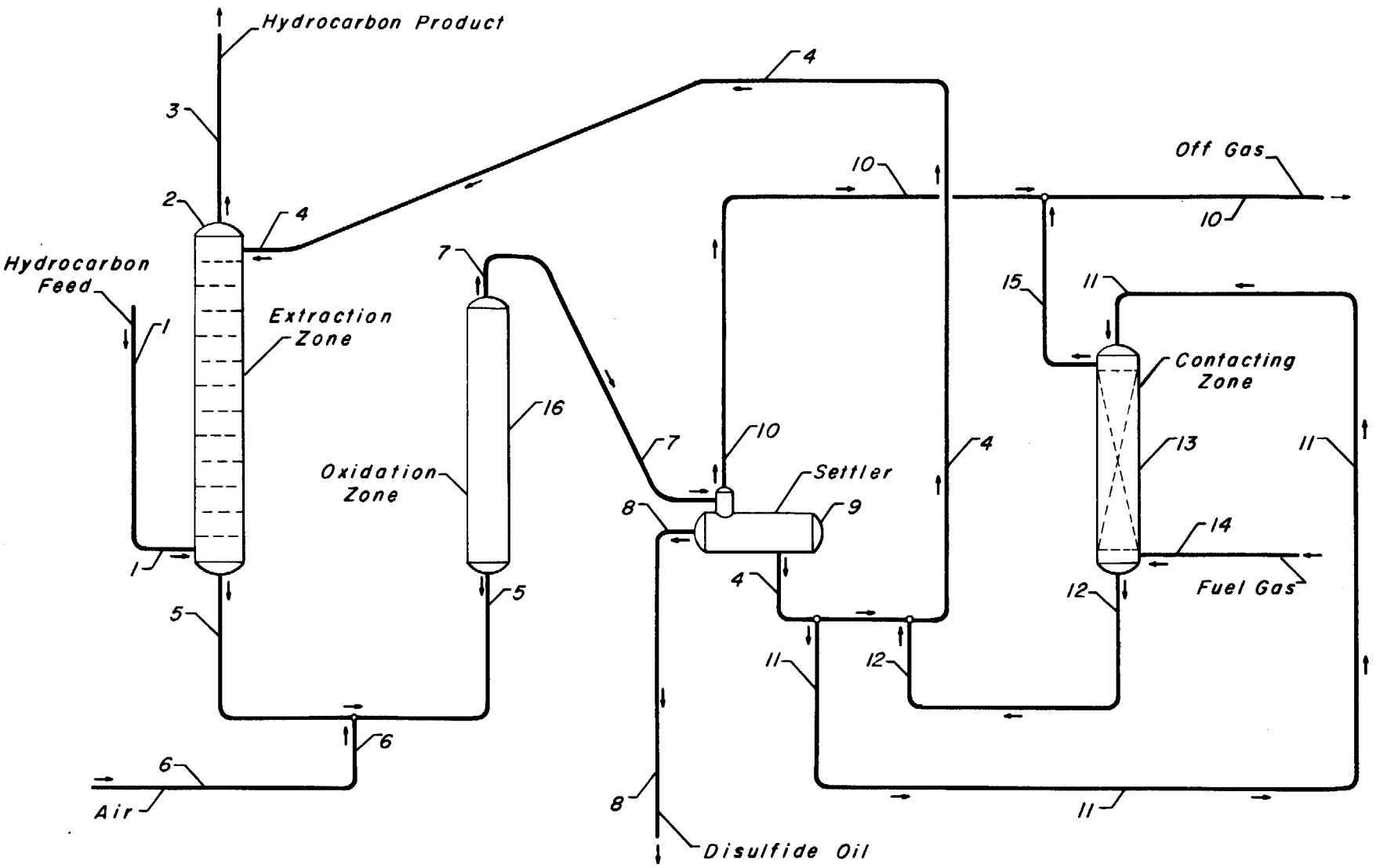
Off Gas
Contacting Zone
Fuel Gas
Settler
Disulfide Oil
Hydrocarbon Product
Extraction Zone
Oxidation Zone
Hydrocarbon Feed
Air
1
2
3
4
5
6
7
8
9
10
11
12
13
14
15
16

MERCAPTAN EXTRACTION PROCESS UTILIZING A STRIPPED ALKALINE SOLUTION

FIELD OF THE INVENTION

The invention relates to a process for refining mineral oils such as found in class 208. It more specifically relates to a mercaptan extraction process utilizing an alkaline solution which is regenerated by contact with oxygen and a phthalocyanine catalyst such as the processes found in Classes 208-203 and 208-206.

PRIOR ART

The prior art of mercaptan extraction with alkaline solutions is well developed. Specific examples in which the alkaline solution is regenerated through oxidation of the mercaptans to disulfides are presented by U.S. Pat. Nos. 2,853,432 (Cl. 196–32); 2,921,020 (Cl. 208-205); 2,988,500 (Cl. 208-206) and 3,408,287 (Cl. 208–207). These references illustrate the common practice of admixing air with the mercaptan-containing extract stream to support the catalyzed oxidation and the subsequent passage of the oxidation zone effluent into a phase separation zone from which the excess air is vented. They also describe the removal of the alkaline stream from the phase separation zone and its recirculation to the extraction zone.

Heretofore, mercaptan extraction units operated in this manner have not been designed for feed streams containing over about 1000 wt. ppm. of sulfur in the form of various mercaptans. The amount of water formed by oxidation in the process has therefore been less and could be removed by the off-gas stream vented from the phase separation zone.

BRIEF SUMMARY OF THE INVENTION

The preferred embodiment of the invention comprises concentrating the regenerated alkaline solution removed from the phase separation zone through the steps of countercurrently contacting a liquid stream containing a portion of the regenerated alkaline solution with a hydrocarbon-containing vapor stream at conditions which effect the transfer of water into the vapor stream, admixing the liquid stream with the remainder of the regenerated alkaline solution to form the alkaline stream fed into a mercaptan extraction zone and admixing the vapor stream with an off-gas stream removed from the phase separation. Therefore, by the method of the invention the vapor stream normally used just to enrich the offgas stream above its explosive limit performs the additional beneficial function of removing water vapor from the alkaline solution.

DESCRIPTION OF THE DRAWING

The drawing illustrates the preferred embodiment of the invention. A hydrocarbon feed stream, such as a naphtha containing a relatively high amount of mercaptans, enters the lower end of an extraction zone 2 through line 1. It passes upward countercurrent to a substantially mercaptan-free aqueous alkaline stream which enters the extraction zone through line 4. The normal liquid-liquid extraction operation results in the transfer of essentially all of the mercaptans in the feed stream to the alkaline stream and the formation of a mercaptan-containing alkaline stream removed in line 5. The hydrocarbons leave the extraction zone as a treated product stream in line 3.

A stream of air from line 6 is admixed with the mercaptan-containing alkaline stream and the resulting admixture is passed into the oxidation zone 16. Within the oxidation zone there is affected the oxidation of essentially all of the mercaptans in the admixture to disulfide compounds. An oxidation zone effluent stream is passed through line 7 into a settler 9 which functions as a phase separation zone. The disulfide compounds separate out as a separate liquid phase and are removed as a by-product stream through line 8.

The excess oxygen and the nitrogen in the air stream are removed from the settler as a vapor stream through line 10. A denser aqueous phase containing the alkaline material is removed as a liquid stream in line 4. The majority of this stream continues through line 4, while a portion thereof is diverted into line 11. This portion is passed into the top of a vapor-liquid contacting zone 13. A vapor stream rich in volatile hydrocarbons, such as a fuel gas, enters the bottom of the contacting zone via line 14 and passes countercurrent to the liquid. The contacting zone is maintained at conditions which cause water to transfer from the liquid to the vapor stream. This results in the concentration of the alkaline material in the liquid, which is then removed in line 12 and admixed with the undiverted portion of the liquid stream traveling through line 4. A vapor stream containing the volatile hydrocarbons and water is removed from the top of the contacting zone via line 15. This vapor stream is then admixed with the vapor stream in line 10 to produce an off-gas stream having a hydrocarbon concentration above the explosive limit of the oxygen-hydrocarbon mixture contained therein.

This drawing is a schematic outline of the basic and preferred method of the invention. It is not intended to plae any limitation on the scope or practice of the invention or to exclude the large numer of variations in this general flow scheme will be apparent to those skilled in the art. Various required subsystems such as pumps, valves, control systems, sensors and heaters have been deleted for the purposes of simplicity and clarity of presentation.

DETAILED DESCRIPTION

Processes which extract mercaptans from hydrocarbon streams by contacting the stream with an alkaline solution are very widely used. In a large number of these processes the alkaline solution is comprised of water and an alkaline reagent and the solution is regenerated by the catalyzed oxidation of the mercaptans to disulfides and the subsequent separation of the disulfides from the solution. As made evident by the previously cited references, those skilled in the prior art are well acquainted with these processes.

Oxygen required for the regeneration of the alkaline solution is preferably supplied by the admixture of air into the mercaptan-containing alkaline solution. Other sources of oxygen may, however, be used. The air is normally injected at a rate which ensures an excess of oxygen above that required for the oxidation. The alkaline solution and air are then passed through an oxidation zone operated as described herein, and the effluent of the oxidation zone is passed into a phase separation zone. The excess of oxygen admixed with the alkaline solution results in the presence of unused oxygen in the phase separation zone. This, along with the nitrogen from the air and some water vapor, is removed as a relatively small vapor stream. The presence of oxygen vapor in any process stream calls for the utmost care in preventing the accidental formation of explosive mixtures by the oxygen-containing stream becoming admixed with hydrocarbons or other combustibles. It is therefore the standard practice to purposely admix this stream with a stream of volatile hydrocarbons which is sufficient to establish a hydrocarbon concentration above the explosive limit of the resulting mixture. In this way any accidental admixture with hydrocarbons only results in a further enrichment of the stream in hydrocarbons and cannot lead to an explosive mixture. The vapor stream used for this purpose is preferably a fuel gas stream, that is, one which is scheduled for combustion, and the resulting admixture is used as fuel.

Water is formed as a by-product of the oxidation of the mercaptans. With relatively low mercaptan concentrations in the feed stream the amount of water vapor which leaves the process in the vapor stream removed from the phase separation zone normally equals the rate of water formation. However, at mercaptan concentrations above about 2000 wt. ppm. in the feed stream the water begins to accumulate and dilute the alkaline solution. In many refinery streams this mercaptan concentration is roughly equal to a 1000 wt. ppm. concentration of sulfur. This excess water should be removed to maintain the effectiveness of the alkaline solution. It is therefore an objective of the invention to provide a method of removing from the alkaline solution the water formed as by-product of mercaptan oxidation in a mercaptan extraction process. It is a further objective to provide a method of removing water formed as a by-product of such mercaptan oxidation in a manner which is integrated with and proves a synergistic benefit by the enrichment of the off-gas stream above its explosive limit.

This objective is achieved by contacting at least a portion of the regenerated alkaline solution which is removed from the phase separation zone with the stream of volatile hydrocarbons admixed with the phase separation zone off-gas stream. The volatile hydrocarbons used in the vapor-liquid contacting zone may be derived from the treated product if the feed stream consists of volatile hydrocarbons. This contacting is conducted in a vapor-liquid contacting zone operated at conditions which promote the transfer of water from the alkaline solution to the vapor stream. The contacting zone is preferably a packed bed, but may be a tower containing a number of horizontal trays containing apparatus to promote contacting or any other suitable means. This causes the vapor stream leaving the contacting zone to contain both water vapor and the volatile hydrocarbons. As used herein, the term "volatile hydrocarbons" refers to hydrocarbons having less than five carbon atoms per molecule. Initially there should be no need to remove water from the alkaline solution. The operation of the contacting zone is therefore preferably not initiated until the solution has been diluted to some measurable extent.

The contacting step will normally be conducted at a pressure very close to that present in the phase separation zone and in the extraction zone. The pressure in these two zones will normally differ by the increased pressure resulting from the pump used to recirculate the alkaline solution. However, as the following examples illustrate, the extraction zone may be operated at a substantially higher pressure. The pressure in the vapor-liquid contacting zone may range up to 1000 psig. but is preferably between about 50 psig. to about 150 psig. The temperature in the contacting zone is to be confined within the range of about 50° F. to about 250° F., and preferably from 100° F. to 200° F. The amount of water removed may be regulated by adjusting the temperature or pressure in the contacting zone or the rate at which the vapor stream is passed through the zone. Adjustment of the contacting conditions is the preferred method. The volumetric rate of flow of the vapor stream required to remove this water is dependent on such factors as the water content of the incoming vapor, the conditions utilized in the contacting zone, the efficiency of the contacting operation and the amount of water to be removed. In general, it is preferred that about 0.001 to about 0.01 mole of gas be passed through the contacting zone for each pound of alkaline solution to be treated therein.

After passing through the vapor-liquid contacting zone, the now more concentrated portion of the alkaline solution is reunited with the portion not passed through the zone. This combined stream is then charged to the extraction zone. It is also possible to contact the totality of the alkaline solution with the vapor stream. Other basic variations in the flow scheme include the use of a common regeneration system, that is oxidation and phase separation zones, for two or more extraction zones. A third modification of the flow described above includes keeping the two portions of regenerated alkaline solution separate and passing the more concentrated portion into a different extraction zone or into the same extraction zone at a different point.

The subject extraction process may utilize any alkaline reagent which is capable of extracting mercaptans from the feed stream at practical operating conditions and which may be regenerated in the manner described. A preferred alkaline reagent comprises an aqueous solution of an alkaline metal hydroxide, such as sodium hydroxide or potassium hydroxide. Sodium hydroxide, commonly referred to as caustic, may be used in concentrations of from 1 to 50 wt.%, with a preferred concentration range being from about 5 to about 25 wt.%. Optionally, there may be added an agent to increase the solubility of the mercaptans in the solution, typically methanol or ethanol although others such as a phenol, cresol or butyric acid may be used.

Hydrocarbons suitable for mercaptan removal in the extraction zone vary from propane-butane mixtures to middle distillates. Included in this range are streams derived from fluidized catalytic cracking plant gas condensation units, natural or cracked gasolines, jet fuels, fuel oils, kerosenes and blends of these materials. The process may also be used to remove mercaptans from many solvents, alcohols, aldehydes, etc. In general, these materials may be classified as being normally liquid hydrocarbonaceous compounds having boiling points under about 650° F.

The conditions employed in the extraction zone may vary greatly depending on such factors as the nature of the hydrocarbon stream being treated and its mercaptan content, etc. In general, the extraction may be performed at an ambient temperature above about 60° F. and at a pressure sufficient to ensure liquid state operation. With very light material in the feed stream, this may be impractical and the extraction is performed with a vapor phase feed stream. The pressure may range from atmospheric up to 1000 psig. or more, but a pressure in the range of from about 50 psig. to about 15 psig. is preferred.

A second consideration is that the pressure chosen should ensure an adequate amount of oxygen is dissolved in the alkaline stream in the downstream oxidation step, which if practical is preferably operated at substantially the same pressure as the extraction zone after normal process flow pressure drops are taken into consideration. The temperature in the extraction zone is confined within the range of 50° F. to about 250° F., preferably from 80° F. to 120° F. The ratio of the volume of the alkaline solution required per volume of the feed stream will vary depending on the mercaptan content of the feed stream. Normally this ratio will be between 0.01:1 to 1:1, although other ratios may be desirable. The rate of flow of the alkaline solution will typically be about 2 to 3% of the rate of flow of an LPG stream and may be up to about 20% of a light straight run naphtha stream. Optimum extraction in this liquid system is obtained with a velocity through the perforations of from about 5 to about 10 feet per second. Essentially all of the extractable mercaptans should be transferred to the alkaline solution from the feed stream. As used herein, the term "essentially all" is intended to refer to at least 95% and preferably 98% of all the material referred to.

Proper operation of the extraction zone results in the formation of a mercaptan-containing alkaline stream which is mixed with an air stream. At least the stoichiometric amount of oxygen necessary to oxidize the mercaptans should be used. The air or other oxidizing agent is well admixed with the liquid alkaline stream and then passed into the oxidation zone. As already pointed out, the oxidation of the mercaptans is promoted through the presence of a catalytically effective amount of an oxidation catalyst capable of functioning at the conditions found in the oxidizing zone. Several suitable materials are known in the art. Preferred as a catalyst is a metal phthalocyanine such as cobalt phthalocyanine or vanadium phthalocyanine, etc. Higher catalytic activity may be obtained through the use of a polar derivative of the metal phthalocyanine, especially the monosulfo, disulfo, trisulfo, and tetrasulfo derivatives.

The preferred oxidation catalysts may be utilized in a form which is soluble or suspended in the alkaline solution or it may be placed on a solid carrier material. If the catalyst is present in the solution, it is preferably cobalt or vanadium phthalocyanine disulfonate at a concentration of from about 5 to 1000 wt. ppm. Carrier materials should be highly absorptive and capable of withstanding the alkaline environment. Activated charcoals have been found very suitable for this purpose, and either animal or vegetable charcoals may be used. The carrier material is to be suspended in a fixed bed which provides efficient circulation of the alkaline solution. Preferably the metal phthalocyanine compound comprises about 0.1 to 2.0 wt.% of the final composite. More detailed information on liquid-phase catalysts and their usage may be obtained from U.S. Pat. Nos. 2,853,432 and 2,882,224. Likewise, further information on fixed bed operations is contained in U.S. Pat. Nos. 2,988,500; 3,108,081 and 3,148,156. The oxidation conditions utilized include a pressure of from atmospheric to about 1000 psig., and preferably are substantially the same as used in the extraction zone. The temperature may range from ambient to about 200° F. when operating near atmospheric pressure and to about 400° F. when operating at superatmospheric pressures. In general, it is preferred that a temperature within the range of about 100° F. to about 175° F. is utilized. The oxidation zone preferably contains a packed bed to ensure intimate mixing. This is done in all cases, including when the catalyst is circulated with the alkaline solution.

The phase separation zone may be of any suitable configuration, with a settler such as represented in the drawing being preferred. The phase separation zone is sized to allow the denser alkaline solution to separate by gravity from the disulfide compounds. This may be aided by a coalescing means located in the zone. Normally, a residence time in excess of 90 minutes is provided. A stream of a suitable hydrocarbon, such as a naphtha, is in some instances admixed with the material entering the zone to aid in the separation of the two liquid materials. There is formed in this zone a first liquid phase containing the aqueous alkaline solution and a second liquid phase containing the disulfide compounds. The disulfide compounds are removed from the process as by-product stream, and the aqueous alkaline solution is withdrawn for concentration and reuse.

It is desirable to run the phase separation zone at the minimum pressure which other design considerations will allow. This is to promote the transfer of the excess oxygen, nitrogen and water into the vapor phase. However, if the extraction zone is operated at a relatively high pressure, then an intermediate pressure which avoids some of the utilities expense of repressurizing the alkaline solution is preferred. The pressure in the phase separation zone may therefore range from atmospheric to about 300 psig. or more, but a pressure in the range of from about 10 psig. to 50 psig., is preferred. The temperature in this zone is confined within the range of from about 50° F. to about 250° F., and preferably from about 80° F. to 130° F.

To facilitate a better understanding of the preferred embodiment, an example of its usage will be given. In this example, the feed stream is comprised of a 129.2° API liquefied petroleum gas having an average molecular weight of 47.1. The feed stream has a flow rate of 2,172 barrels per day (BPD) and is fed to the extraction zone as a liquid at a pressure of 330 psig. and a temperature of 100° F. A 10.6 gallon per minute (gpm) lean alkaline stream comprising sodium hydroxide enters the top of the extractor at 100° F. and has a specific gravity of 1.149. A mercaptan-containing rich caustic stream is removed from the extraction zone and reduced in pressure to about 65 psig. This stream is then warmed to about 120° F. and admixed with a phthalocyanine catalyst and about 17 moles per hour of air. The resulting admixture is passed upward through an oxidation zone containing a packed bed. The effluent of the oxidation zone is admixed with a 1.4 gpm naphtha stream which serves to promote the separation of the disulfide compounds from the aqueous alkaline phase and is passed into the phase separation zone. The separator used as this zone has a 4-foot diameter and 20.5-foot tangent length.

A liquid stream containing the disulfide compounds and the naphtha is removed as the by-product disulfide oil stream at a pressure of 45 psig. A vapor stream of about 15.9 moles per hour is removed as the vent gas stream and contains about 6 lbs./hr. of water vapor. A stream of regenerated lean alkaline solution having a specific gravity of 1.142 is removed from the separation zone at a temperature of about 123° F. and divided into two portions. A first, 4 gpm portion is heated to about 152° F. and passed into the top of a packed vapor-liquid contacting zone at a pressure of 5 psig. This portion of the alkaline solution is contacted with a 15 mole per hour stream of the treated feed stream removed from the extraction zone. This vapor stream enters the contacting zone at 100° F. and a pressure of 10 psig. A liquid stream of about 3.9 gpm is removed from the contacting zone at 120° F. and combined with the alkaline solution which did not enter this zone to form the lean alkaline solution charged to the extraction zone. An 18 mole per hour vapor stream containing about 60 lbs./hr. of water vapor is removed from the contacting zone. This vapor stream is combined with the offgas stream removed from the phase separation zone and passed to a heater for use as fuel.

In accordance with this example and the prior description, the preferred embodiment may be characterized as a continuous process for removing mercaptans from a feed stream comprising at least 2000 wt. ppm. mercaptans and a mixture of hydrocarbons having boiling points below about 650° F. which comprises the steps of contacting the feed stream with a first alkaline stream comprising water and an alkaline reagent in an extraction zone maintained at extraction conditions effective to promote the transfer of essentially all of the mercaptans from the feed stream to the first alkaline stream and the formation of a treated product stream, which is removed from the extraction zone, and a mercaptan-containing alkaline stream, contacting the mercaptan-containing alkaline stream with oxygen in the presence of an oxidation catalyst in an oxidation zone at conditions effective to form an oxidation zone effluent stream comprising disulfide compounds, the alkaline reagent and water, separating the oxidation zone effluent stream in a phase separation zone operated at conditions selected to produce a first liquid phase comprising the alkaline reagent and water, a second liquid phase comprising disulfide compounds and a first gaseous phase comprising oxygen, withdrawing a by-product stream comprising disulfide compounds from the phase separation zone, withdrawing a liquid stream comprising the alkaline reagent and water from the phase separation zone, dividing the liquid stream into a first aliquot portion and a larger second aliquot portion and contacting the first aliquot portion of the liquid stream with a first vapor stream comprising volatile hydrocarbons in a vapor-liquid contacting zone operated at conditions effective to promote the transfer of water from the first aliquot portion of the liquid stream to the first vapor stream and the formation of a second vapor stream comprising volatile hydrocarbons and water, recombining the first aliquot portion and the second aliquot portion of the liquid stream and effecting the formation thereby of a second alkaline stream, passing at least a portion of the second alkaline stream into the extraction zone as the first alkaline stream, and withdrawing a third vapor stream comprising oxygen from the phase separation zone and admixing and the second vapor stream with the third vapor stream.

The following example illustrates the operation of a process utilizing the inventive concept in which all of the regenerated alkaline solution is passed through the vapor-liquid contacting zone. The feed stream in this example is lighter and will be treated as a vapor in the extraction zone. It is derived from an asphalt thermal cracking process and intended for use as a fuel gas. Therefore various mercaptans and other sulfur compounds present at concentrations varying up to 6600 wt. ppm. must be removed to make the gas suitable for this purpose. The example also illustrates the use of a portion of the treated LPG as the volatile hydrocarbons used to concentrate the alkaline solution.

The feed stream contains about 3.7 vol.% hydrogen, 35.9 vol.% methane, 18.1 vol.% ethane, 6.7 vol.% propylene, 10.9 vol.% propane and various other volatile hydrocarbons. It also contains a maximum of about 100 vol. ppm. of water and about 2000 vol. ppm. of carbon dioxide. It is assumed the feed stream is treated by contact with an amine solution to remove the majority of the hydrogen disulfide present. However, residual amounts of this material are preferably removed prior to the introduction of feed stream into the extraction zone. This is performed through the use of a sodium hydroxide prewash in which the 10 Be. caustic solution is continuously replaced at a rate of about 1.7 gpm. The feed stream enters the extraction zone at 104° F. and a pressure of about 58 psig. at a flow rate of about 494 moles per hour. The alkaline stream, which is also a sodium hydroxide sosolution, enters the extraction zone at a rate of about 6.9 gpm and a temperature of 104° F. The countercurrent contacting results in the transfer of essentially all of the mercaptans in the feed stream to the alkaline stream. Of these mercaptans, about 71 vol.% have one carbon atom per molecule, while about 20.5 vol.% have two and about 7 vol.% have three carbon atoms per molecule. The resulting treated fuel gas leaves at a rate of about 492 moles per hour.

The mercaptan-containing alkaline solution removed from the extraction zone is heated to about 125° F. and admixed with an air stream having a flow rate of about 7 moles per hour. The resulting admixture is passed into the oxidation zone at about 38 psig. The phthalocyanine oxidation catalyst is circulated through the system admixed with the liquid alkaline stream. This results in the oxidation of the mercaptans to disulfides and the formation of water as a by-product of the oxidation. All of the effluent of the oxidation zone is then passed into the phase separation zone at a pressure of about 33 psig. and a temperature of 125° F. The off-gas stream removed from this zone has a flow rate of about 6.6 moles per hour and includes about 4 lbs./hr. of water vapor. This vapor stream has an average molecular weight of about 28.2.

A 7.0 gpm stream of regenerated alkaline solution having a specific gravity of about 1.055 is removed from the phase separation at a pressure of 33 psig. and warmed to a temperature of about 152° F. This entire stream is then passed into the upper end of a packed bed vapor-liquid contacting zone. A 6.4 mole per hour stream of the treated feed stream is passed into the bottom of the contacting zone at 6 psig. and 104° F. The resulting vapor stream removed from this zone has an average molecular weight of 29.8, a temperature of about 152° F. and a flow rate of about 7.6 moles per hour. This vapor stream is then combined with the off-gas stream removed from the phase separation zone to enrich that stream in hydrocarbons and thereby exceed the hydrocarbon concentration of the explosive limit of the resulting mixture. The liquid alkaline solution is removed at a temperature of about 144° F. and passed through a cooler. It is then recycled to the extraction zone.

I claim as my invention:

1. A continuous process for the removal of mercaptans from a feed strem comprising at least 2000 wt. ppm. mercaptans and a mixture of hydrocarbons having boiling points below about 650° F., which comprises the steps of:

a. contacting the feed stream with an alkaline solution comprising water and an alkaline reagent in an extraction zone maintained at extraction conditions effective to promote the transfer of essentially all of the mercaptans from the feed stream to the alkaline solution and the formation of a treated product stream, which is removed from the extraction zone, and a mercaptan-containing alkaline solution;

b. contacting the mercaptan-containing alkaline solution with oxygen with an oxidation catalyst in an oxidation zone at conditions effective to form an oxidation zone effluent stream comprising disulfide compounds, in said alkaline solution;

c. passing the oxidation zone effluent stream into a phase separation zone operated at conditions selected to produce a first liquid phase comprising said alkaline solution, a second liquid phase comprising said disulfide compounds and an off-gas stream comprising oxygen;

d. withdrawing the second liquid phase from the phase separation zone of step (c);

e. recycling a first portion of said first liquid phase from step (c) to the extraction zone of step (a);

f. removing said off-gas stream from said process in admixture with a first vapor stream as hereinafter delineated;

g. countercurrently contacting a second portion of said first liquid phase with a second vapor stream comprising hydrocarbons having less than five carbon atoms at conditions effective to strip water from said second portion of said first liquid phase and to form said first vapor stream; and, h. admixing the stripped second portion of said first liquid phase from step (g) with said first portion of said first liquid phase of step (e) being recycled to the extraction zone to form said alkaline solution of step (a), whereby water formed in the oxidation zone is removed from the process and the concentration of alkaline reagent in the alkaline solution is controlled.

2. The process of claim 1 further characterized in that the alkaline reagent is an alkali metal hydroxide.

3. The process of claim 2 further characterized in that the oxidation catalyst is a metal phthalocyanine.

4. The process of claim 3 further characterized in that the oxidation catalyst is admixed with the mercaptan-containing alkaline solution and circulated with the alkaline stream through the process.

5. The process of claim 3 further characterized in that the oxidation catalyst is supported on a bed of solid carrier material located in the oxidation zone.

* * * * *